US011482164B2

(12) United States Patent
Choi et al.

(10) Patent No.: US 11,482,164 B2
(45) Date of Patent: Oct. 25, 2022

(54) DISPLAY DEVICE

(71) Applicant: SAMSUNG DISPLAY CO., LTD., Yongin-si (KR)

(72) Inventors: Eun Jin Choi, Yongin-si (KR); Won Jin Seo, Yongin-si (KR); Ki Hyun Pyun, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/459,554

(22) Filed: Aug. 27, 2021

(65) Prior Publication Data

US 2022/0157225 A1 May 19, 2022

(30) Foreign Application Priority Data

Nov. 17, 2020 (KR) ..... 10-2020-0154023

(51) Int. Cl.
*G09G 3/32* (2016.01)

(52) U.S. Cl.
CPC ..... *G09G 3/32* (2013.01); *G09G 2310/027* (2013.01); *G09G 2310/0243* (2013.01); *G09G 2310/08* (2013.01); *G09G 2320/041* (2013.01)

(58) Field of Classification Search
CPC ..... G09G 3/32; G09G 2310/0243; G09G 2310/027; G09G 2310/08; G09G 2320/041
See application file for complete search history.

(56) References Cited

U.S. PATENT DOCUMENTS

| | | | | |
|---|---|---|---|---|
| 8,711,084 | B2 | 4/2014 | Lee et al. | |
| 2017/0213493 | A1* | 7/2017 | Han | G09G 3/3208 |
| 2018/0218662 | A1* | 8/2018 | Hu | G09G 3/36 |
| 2019/0080648 | A1* | 3/2019 | Hwang | G09G 3/3266 |
| 2019/0206356 | A1* | 7/2019 | Kim | G09G 3/3655 |
| 2020/0312235 | A1* | 10/2020 | Kim | G09G 3/3208 |

FOREIGN PATENT DOCUMENTS

| | | | |
|---|---|---|---|
| KR | 101329966 | B1 | 11/2013 |
| KR | 102045981 | B1 | 11/2019 |
| KR | 102172392 | B1 | 11/2020 |

* cited by examiner

*Primary Examiner* — Andrew Sasinowski
(74) *Attorney, Agent, or Firm* — Cantor Colburn LLP

(57) ABSTRACT

A display device includes a pixel unit including pixels, a compensator which generate compensation image data by scaling grayscale values of input image data based on temperature data corresponding to an ambient temperature of the pixel unit, a timing controller which generates image data based on the compensation image data, and a data driver which generates a data signal corresponding to the image data and supply the data signal to the pixels. The compensator scales the grayscale values of the input image data in a way such that the grayscale values of the input image data decrease when the ambient temperature is greater than a reference temperature. The compensator scales the grayscale values of the input image data in a way such that the grayscale values of the input image data increase when the ambient temperature is less than the reference temperature.

20 Claims, 10 Drawing Sheets

FIG. 7A

| | Grayscale | Vdata (V) |
|---|---|---|
| GSA1 | 1 | 0.905 |
| | ⋮ | ⋮ |
| | 245 | 7.396 |
| | 246 | 7.419 |
| | 247 | 7.442 |
| | 248 | 7.465 |
| | 249 | 7.488 |
| | 250 | 7.511 |
| | 251 | 7.535 |
| | 252 | 7.558 |
| | 253 | 7.581 |
| | 254 | 7.604 |
| | 255 | 7.628 |

VGM: 8V

FIG. 7B

| | Grayscale | Vdata (V) |
|---|---|---|
| GSA1 | 1 | 0.905 |
| | ⋮ | ⋮ |
| | 245 | 7.396 |
| | 246 | 7.419 |
| | 247 | 7.442 |
| | 248 | 7.465 |
| | 249 | 7.488 |
| | 250 | 7.511 |
| | 251 | 7.535 |
| | 252 | 7.558 |
| | 253 | 7.581 |
| | 254 | 7.604 |
| | 255 | 7.628 |
| GSA2 | 256 | 7.652 |
| | 257 | 7.676 |
| | 258 | 7.700 |
| | ⋮ | ⋮ |
| | 268 | 7.940 |
| | 269 | 7.964 |
| | 270 | 7.988 |

VGM: 8V

DISPLAY DEVICE

This application claims priority to Korean Patent Application No. 10-2020-0154023, filed on Nov. 17, 2020, and all the benefits accruing therefrom under 35 U.S.C. § 119, the content of which in its entirety is herein incorporated by reference.

BACKGROUND

1. Field

The disclosure relates to a display device.

2. Description of the Related Art

A display device may include a display panel for displaying an image. The display panel may include pixels, and a light emitting element included in each of the pixels may emit light at a luminance corresponding to a driving current amount.

SUMMARY

In such a display device, a current value flowing through a display panel may change according to an ambient temperature of the display panel, and thus the display panel may emit light at a luminance different from a target luminance. Accordingly, an image to be displayed on the display panel is desired to be controlled to be displayed with a target luminance regardless of change in the ambient temperature of the display panel.

An embodiment of the disclosure is to provide a display device capable of displaying an image of a target luminance regardless of change in an ambient temperature.

According to an embodiment, a display device includes a pixel unit including pixels, a compensator which generates compensation image data by scaling grayscale values of input image data based on temperature data corresponding to an ambient temperature of the pixel unit, a timing controller which generates image data based on the compensation image data, and a data driver which generates a data signal corresponding to the image data and supply the data signal to the pixels. In such an embodiment, the compensator scales the grayscale values of the input image data in a way such that the grayscale values of the input image data decrease when the ambient temperature is greater than a reference temperature. In such an embodiment, the compensator scales the grayscale values of the input image data in a way such that the grayscale values of the input image data increase when the ambient temperature is less than the reference temperature.

In an embodiment, the display device may further include a power supply which generates a reference voltage using an input voltage. In such an embodiment, the data driver may generate the data signal using the reference voltage, and the compensator may further generate a power control signal for controlling a voltage level of the reference voltage based on the temperature data.

In an embodiment, the compensator may include a grayscale extractor which extracts a representative grayscale value based on the input image data, a compensation signal generator which generates a first compensation control signal and a second compensation control signal based on the temperature data and the representative grayscale value, and a compensation data generator which generates the compensation image data based on the input image data and the first compensation control signal.

In an embodiment, the representative grayscale value may correspond to a largest grayscale value among the grayscale values of the input image data.

In an embodiment, the compensation signal generator may include a first scale factor generator which generates a first scale factor corresponding to the ambient temperature based on the temperature data, an operator which calculates a first correction grayscale value based on the first scale factor and the representative grayscale value, a comparator which compares the first correction grayscale value and a reference grayscale value to generate comparison result data, and a second scale factor generator which generates a second scale factor corresponding to the first compensation control signal based on the comparison result data.

In an embodiment, the first scale factor generator may generate the first scale factor having a value greater than 1 when the ambient temperature is less than the reference temperature, and the value of the first scale factor may increase as the ambient temperature decreases.

In an embodiment, the first scale factor generator may generate the first scale factor having a value less than 1 when the ambient temperature is greater than the reference temperature, and the value of the first scale factor may decrease as the ambient temperature increases.

In an embodiment, the first scale factor generator may generate the first scale factor having a value of 1 when the ambient temperature and the reference temperature are the same as each other.

In an embodiment, the operator may calculate the first correction grayscale value by multiplying the representative grayscale value by the first scale factor.

In an embodiment, the comparator may calculate a second correction grayscale value in response to the comparison result data.

In an embodiment, the comparator may calculate the second correction grayscale value to be equal to the first correction grayscale value when the first correction grayscale value is equal to or less than the reference grayscale value, and the comparator may calculate the second correction grayscale value to be equal to the reference grayscale value when the first correction grayscale value exceeds the reference grayscale value.

In an embodiment, the compensation signal generator may further include a power control signal generator which generates the power control signal corresponding to the second compensation control signal based on the comparison result data.

In an embodiment, the second scale factor generator may generate the second scale factor having a value less than the first scale factor when the first correction grayscale value and the second correction grayscale value are not the same as each other.

In an embodiment, a value obtained by applying the second scale factor to the representative grayscale value may correspond to the reference grayscale value.

In an embodiment, the power supply may generate the reference voltage having a voltage level different from a voltage level of the input voltage based on the power control signal.

In an embodiment, the second scale factor generator may generate the second scale factor having a same value as the first scale factor when the first correction grayscale value and the second correction grayscale value are the same as each other.

In an embodiment, the power supply may generate the reference voltage having a same voltage level as the input voltage based on the power control signal.

According to an embodiment, a display device includes a pixel unit including pixels, a compensator which generates compensation image data by calculating a target current value corresponding to input image data and scaling grayscale values of the input image data based on the target current value and a global current value flowing through the pixels, a timing controller which generates image data based on the compensation image data, and a data driver which generates a data signal corresponding to the image data and supply the data signal to the pixels. In such an embodiment, the compensator scales the grayscale values of the input image data in a way such that the grayscale values of the input image data decrease when the global current value is greater than the target current value. In such an embodiment, the compensator scales the grayscale values of the input image data in a way such that the grayscale values of the input image data increase when the global current value is less than the target current value.

In an embodiment, the display device may further include a power supply which generates a reference voltage using an input voltage. In such an embodiment, the data driver may generate the data signal using the reference voltage, and the compensator may further generate a power control signal for controlling a voltage level of the reference voltage based on the target current value and the global current value.

In an embodiment, the pixels may be connected to a power line. In such an embodiment, the display device may further include a current sensor which generates the global current value by sensing a current flowing through the power line.

Embodiments of the display device may scale the grayscale values of the input image data and control the voltage level of the reference voltage in correspondence with the ambient temperature of the display panel. Accordingly, an image of a target luminance may be displayed on the display panel regardless of change in the ambient temperature.

In an embodiment, the display device may sense a current flowing through the display panel which may change based on an ambient temperature, scale the grayscale values of the input image data, and control the voltage level of the reference voltage in correspondence with the sensing current value. Accordingly, the image of the target luminance may be displayed on the display panel regardless of change in the ambient temperature.

BRIEF DESCRIPTION OF THE DRAWINGS

The above and other features of the disclosure will become more apparent by describing in further detail embodiments thereof with reference to the accompanying drawings, in which:

FIGS. 7A and 7B are diagrams illustrating embodiments of an operation of the compensator of FIG. 5;

DETAILED DESCRIPTION

Figure 1:
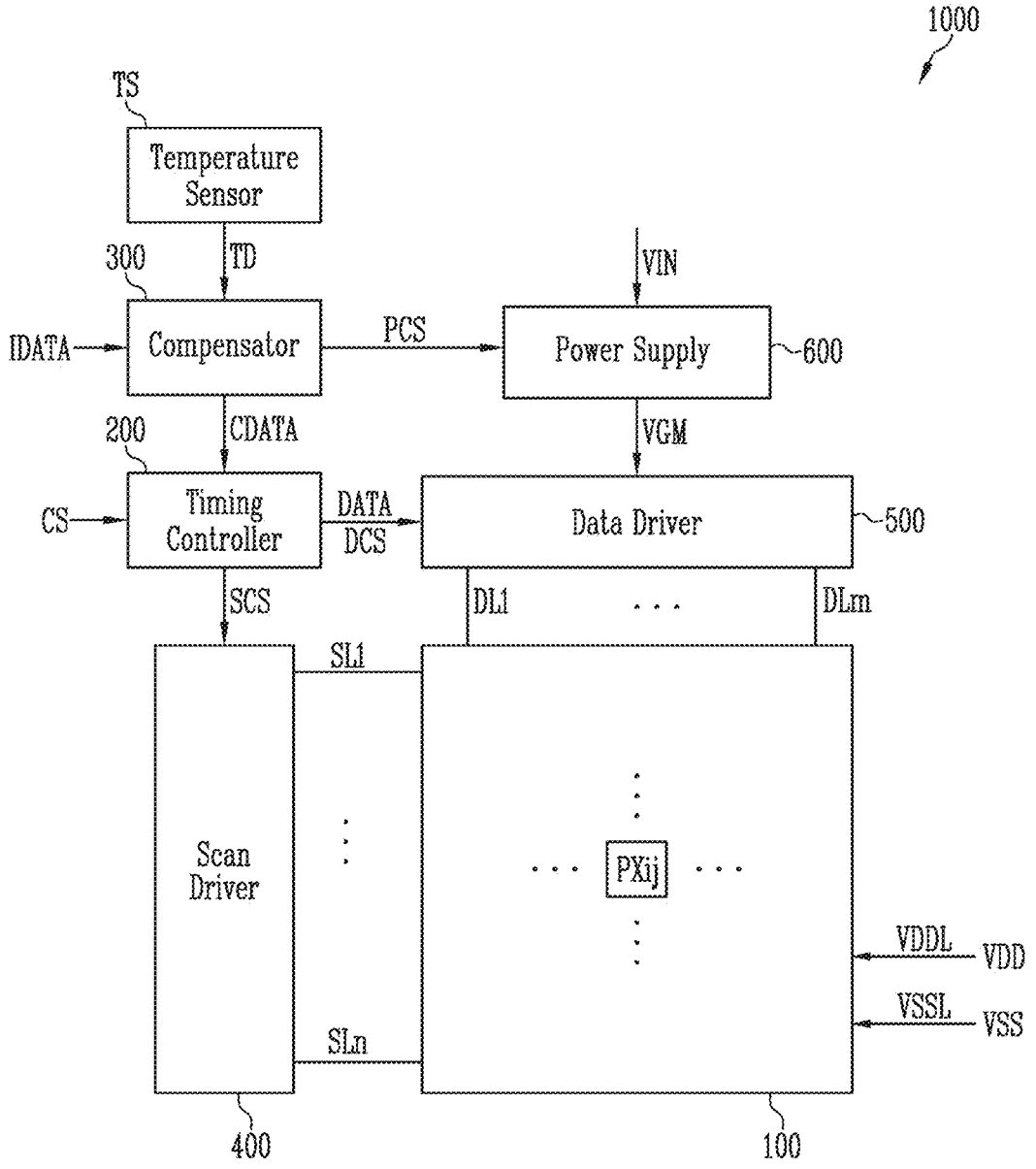
FIG. 1 is a block diagram illustrating a display device according to an embodiment of the disclosure.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

In addition, a case where a portion is "connected" to another portion, the case includes not only a case where the portion is directly connected to the other portion but also a case where the portion is connected to the other portion with another element interposed therebetween.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, embodiments of the disclosure will be described in detail with reference to the accompanying drawings.

Figure 2:
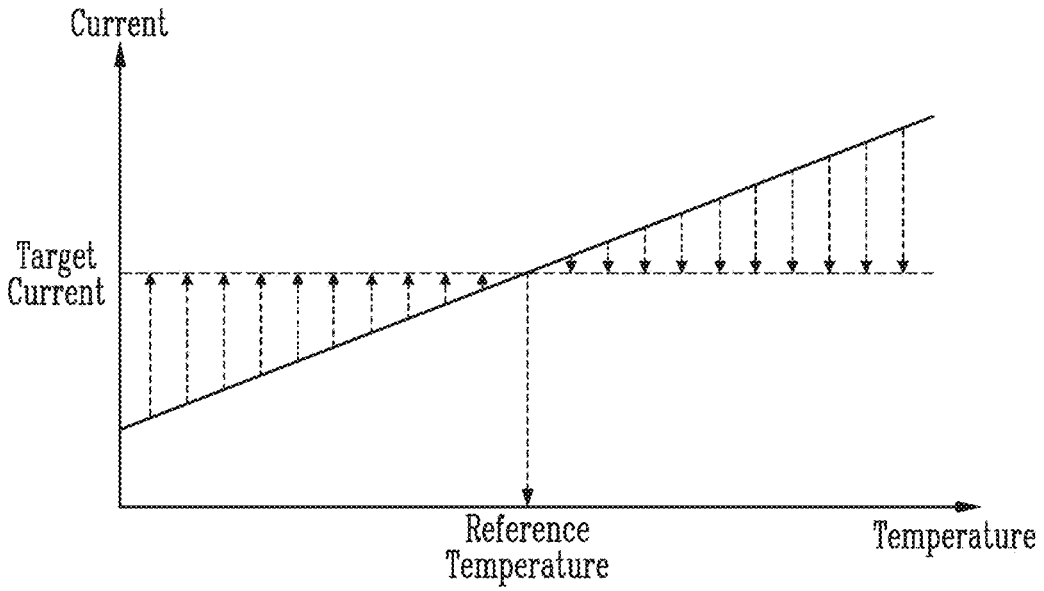
FIG. 2 is a graph illustrating a change of a current flowing through a display panel according to a temperature.

FIG. 1 is a block diagram illustrating a display device according to an embodiment of the disclosure, and FIG. 2 is a graph illustrating a change of a current flowing through a display panel according to a temperature.

Referring to FIG. 1, an embodiment of the display device 1000 may include a display panel 100, a timing controller 200, a compensator 300, a scan driver 400, a data driver 500, and a power supply 600. According to an embodiment, the display device 1000 may further include a temperature sensor TS. The temperature sensor TS may generate temperature data TD by sensing an ambient temperature of the display device 1000 (or the display panel 100).

The display panel 100 (or a pixel unit) may include pixels. Each pixel PXij may be connected to a corresponding data line among data lines DL1 to DLm and a corresponding scan line among scan lines SL1 to SLn. Here, n and m may be integers greater than 0. The pixel PXij may mean a pixel in which a scan transistor is connected to an i-th scan line and a j-th data line, where i and j may be integers greater than 0 and less than or equal to n and m, respectively.

Each pixel PXij may be connected to a first power line VDDL and a second power line VSSL. The pixel PXij may receive a voltage of first power VDD through the first power line VDDL and receive a voltage of second power VSS through the second power line VSSL. Here, the voltages of the first power VDD and the second power VSS may be voltages used for an operation of the pixels. The first power VDD may have a voltage level higher than that of the second power VSS. In one embodiment, for example, the voltage of the first power VDD may be a positive voltage, and the voltage of the second power VSS may be a negative voltage.

The timing controller 200 may receive a control signal CS from an outside or an external device. Here, the control signal CS may include a synchronization signal, a clock signal, and the like.

The timing controller 200 may generate a first control signal SCS (or a scan control signal) and a second control signal DCS (or a data control signal) based on the control signal CS. The timing controller 200 may supply the first control signal SCS to the scan driver 400 and may supply the second control signal DCS to the data driver 500.

The first control signal SCS may include a scan start signal, a clock signal, and the like. The scan start signal may be a signal for controlling a timing of the scan signal. The clock signal included in the first control signal SCS may be used to shift the scan start signal.

The second control signal DCS may include a clock signal supplied to a register of the data driver 500, a line latch signal supplied to a latch, and the like.

The compensator 300 may receive input image data IDATA from an outside. Here, the input image data IDATA may include at least one image frame.

In an embodiment, the compensator 300 may receive the temperature data TD from the temperature sensor TS. The compensator 300 may generate a scale factor corresponding to the ambient temperature of the display panel 100 (or the display device 1000) based on the temperature data TD.

In one embodiment, for example, as shown in FIG. 2, when the ambient temperature of the display panel 100 increases to a temperature equal to or greater than a reference temperature (for example, a room temperature), a current flowing through the pixel PXij (or the display panel 100) may be equal to or greater than a target current. Accordingly, a luminance of an image displayed by the display panel 100 may increase to a luminance equal to or greater than a target luminance. In this case, the compensator 300 may generate the scale factor for controlling the target current corresponding to the target luminance of the display image to flow through the pixel PXij based on the temperature data TD. Here, the scale factor may be less than 1.

In such an embodiment, as shown in FIG. 2, when the ambient temperature of the display panel 100 decreases to a temperature equal to or less than the reference temperature, the current flowing through the pixel PXij (or the display panel 100) may be equal to or less than the target current. Accordingly, the luminance of the image displayed by the display panel 100 may decrease to a luminance equal to or less than the target luminance. In this case, the compensator 300 may generate the scale factor for controlling the target current corresponding to the target luminance of the display image to flow through the pixel PXij based on the temperature data TD. Here, the scale factor may be greater than 1.

The compensator 300 may generate compensation image data CDATA by scaling grayscale values of the input image data IDATA using the scale factor. The compensation data CDATA may be provided to the timing controller 200. The luminance of the image displayed on the display panel 100 may be controlled based on the compensation image data CDATA generated by scaling the grayscale values of the input image data IDATA.

In an embodiment, when the ambient temperature of the display panel 100 is the same as the reference temperature, the compensator 300 may generate a scale factor having a value of 1 to scale the grayscale values of the input image data IDATA. However, the disclosure is not limited thereto. Alternatively, when the ambient temperature of the display panel 100 is the same as the reference temperature, the compensator 300 may provide the input image data IDATA to the timing controller 200 as the compensation data CDATA without scaling the grayscale values of the input image data IDATA.

The timing controller 200 may rearrange the compensation image data CDATA generated by scaling the grayscale values of the input image data IDATA to generate image data DATA of a digital format, and provide the image data DATA to the data driver 500.

The scan driver 400 may receive the first control signal SCS from the timing controller 200 and supply scan signals to the scan lines SL1 to SLn in response to the first control signal SCS. Here, n may be an integer greater than 0. In one embodiment, for example, the scan driver 400 may sequentially supply the scan signals to the scan lines SL1 to SLn. When the scan signals are sequentially supplied, the pixels PXij may be selected in a horizontal line unit (or pixel row unit), and a data signal may be supplied to the selected pixels PXij. In such an embodiment, the scan signal may have a gate on voltage (low voltage or high voltage) so that a transistor (for example, a scan transistor) included in each of the pixels PXij and receiving the scan signal may be turned on.

The data driver 500 may receive the image data DATA and the second control signal DCS from the timing controller 200, convert the image data DATA of the digital format into the data signal of an analog format (data voltage) in response to the second control signal DCS, and supply the data signal to the data lines DL1 to DLm. Here, m may be an integer greater than 0. The data signals supplied to the data lines DL1 to DLm may be supplied to the pixels PXij selected by the scan signals. In such an embodiment, the data driver 500 may supply the data signals to the data lines DL1 to DLm in synchronization with the scan signal.

In such an embodiment, since the image data DATA is generated based on the compensation image data CDATA generated by scaling the grayscale values of the input image data IDATA by the scale factor SF, the data driver 500 may supply the data signals corresponding to the scaled grayscale values to the data lines DL1 to DLm. In one embodiment, for example, the data driver 500 may apply the data signal corresponding to the scaled grayscale value of the pixel PXij to the j-th data line.

The power supply 600 may receive an input voltage VIN from an outside (for example, a battery) and generate a reference voltage VGM based on the input voltage VIN. The reference voltage VGM may be supplied to the data driver 500. The data driver 500 may receive the reference voltage VGM, converts the image data DATA of the digital format into an analog signal, that is, a grayscale voltage, and provide the analog signal to the pixels PXij as the data signal (data voltage).

The data driver 500 may generate a plurality of gamma voltages for expressing predetermined grayscales using the reference voltage VGM. In one embodiment, for example, the data driver 500 may generate the plurality of gamma voltages between a ground voltage and the reference voltage VGM by voltage-dividing the reference voltage VGM. The data driver 500 may provide values corresponding to the image data DATA among the plurality of gamma voltages as the data signal (data voltage) to the pixels PXij.

In an embodiment, where the grayscale value has a value equal to or greater than 0 and equal to or less than 255, a value (or an expectation correction grayscale value) obtained by applying the scale factor to a representative grayscale value corresponding to the largest grayscale value among the grayscale values of the input image data IDATA may not exceed a reference grayscale value (for example, 255 corresponding to the highest grayscale value). Accordingly, a value of the scale factor generated by the compensator 300 may be limited based on the grayscale values (for example, the representative grayscale value) of the input image data IDATA and the ambient temperature.

Accordingly, in an embodiment, when the expectation correction grayscale value exceeds the reference grayscale value, the compensator 300 may generate the scale factor in a way such that a final correction grayscale value is to be equal to or less than the reference grayscale value (for example, the final correction grayscale value is the same as the reference grayscale value), and additionally generate a power control signal PCS for controlling a voltage level of the reference voltage VGM generated by the power supply 600. In one embodiment, for example, the compensator 300 may generate the power control signal PCS for varying (increasing) the voltage level of the reference voltage VGM.

The power supply 600 may provide the data driver 500 with the reference voltage VGM of which the voltage level is varied based on the power control signal PCS. In an embodiment, where the plurality of gamma voltages generated by the data driver 500 are generated by voltage-dividing the reference voltage VGM, values of the gamma voltages may also increase when the reference voltage VGM increases. Accordingly, a voltage level of the data signal (data voltage) generated by the data driver 500 may increase with respect to a same grayscale value.

In an embodiment of the invention, as described above, the compensator 300 may control the luminance of a display image by scaling the grayscale values of the input image data IDATA based on the ambient temperature and by controlling the voltage level of the reference voltage VGM provided to the data driver 500 based on the ambient temperature and the grayscale values. Accordingly, the display panel 100 may display an image of the target luminance regardless of change in the ambient temperature.

Figure 3:
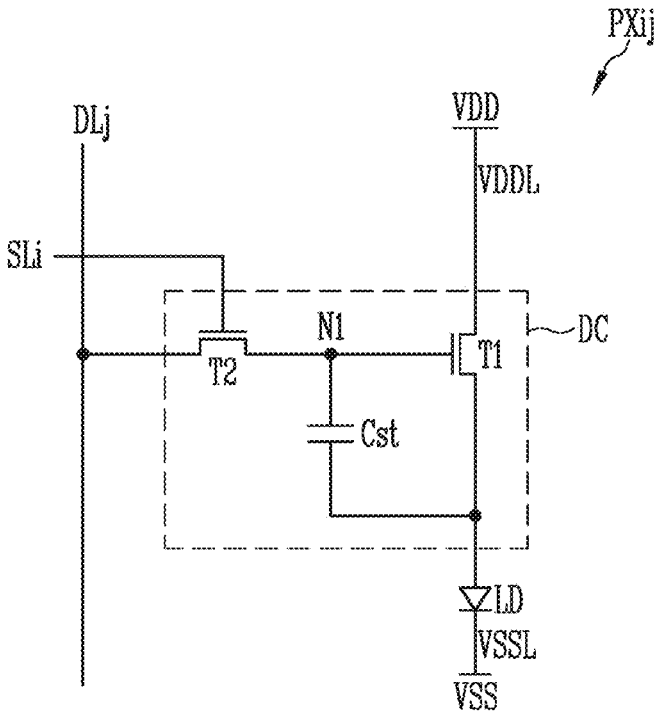
FIG. 3 is a circuit diagram illustrating an embodiment of a pixel included in the display device of FIG. 1.

FIG. 3 is a circuit diagram illustrating an embodiment of the pixel included in the display device of FIG. 1.

Referring to FIG. 3, an embodiment of the pixel PXij may include a light emitting element LD and a driving circuit DC connected to the light emitting element DL to drive the light emitting element LD.

A first electrode (for example, an anode electrode) of the light emitting element LD may be connected to the first power line VDDL via the driving circuit DC, and a second electrode (for example, a cathode electrode) of the light emitting element LD may be connected to the second power line VSSL. The light emitting element LD may emit light at a luminance corresponding to a driving current amount controlled by the driving circuit DC.

In an embodiment, the light emitting element LD may include an organic light emitting diode. In an embodiment, the light emitting element LD may include an inorganic light emitting diode such as a micro light emitting diode or a quantum dot light emitting diode. In an embodiment, the light emitting element LD may be an element including a combination of organic and inorganic materials. In an embodiment, as shown in FIG. 3, the pixel PXij includes a single light emitting element LD, but not being limited thereto. In an alternative embodiment, the pixel PXij may include a plurality of light emitting elements, and the plurality of light emitting elements may be connected with each other in series, in parallel, or in series and parallel.

The first power VDD supplied to the first power line VDDL and the second power VSS supplied to the second power line VSSL may have different potentials from each other. In one embodiment, for example, the voltage of the first power VDD may be greater than the voltage of the second power VSS.

The driving circuit DC may include a first transistor T1, a second transistor T2, and a storage capacitor Cst.

A first electrode of the first transistor T1 (a driving transistor) may be connected to the first power line VDDL, and a second electrode may be electrically connected to the first electrode (for example, the anode electrode) of the light emitting element LD. A gate electrode of the first transistor T1 may be connected to a first node N1. The first transistor T1 may control the driving current amount supplied to the light emitting element LD in correspondence with the data signal supplied to the first node N1 through the data line DLj.

A first electrode of the second transistor T2 (a switching transistor) may be connected to the data line DLj, and the second electrode may be connected to the first node N1. A gate electrode of the second transistor T2 may be connected to the scan line SLi.

The second transistor T2 may be turned on when a scan signal of a voltage (for example, a gate on voltage) at which the second transistor T2 may be turned on is supplied from the scan line SLi, to electrically connect the data line DLj and the first node N1. In such an embodiment, the data signal of a corresponding frame may be supplied to the data line DLj, and thus the data signal may be transferred to the first node N1. A voltage corresponding to the data signal transferred to the first node N1 may be stored in the storage capacitor Cst.

One electrode of the storage capacitor Cst may be connected to the first node N1, and another electrode of the storage capacitor Cst may be connected to the first electrode of the light emitting element LD. The storage capacitor Cst may be charged with the voltage corresponding to the data signal supplied to the first node N1, and may maintain the charged voltage until the data signal of a next frame is supplied.

FIG. 3 shows an embodiment of a pixel PXij having a simple structure for convenience of description, but a structure of the driving circuit DC may be variously changed or modified. In one embodiment, for example, the driving circuit DC may further include other circuit elements such as various transistors such as a compensation transistor for compensating for a threshold voltage of the first transistor T1, an initialization transistor for initializing the first node N1, and/or a light emission control transistor for controlling a light emission time of the light emitting element LD, and a boosting capacitor for boosting the voltage of the first node N1.

In an embodiment, as shown in FIG. 3, the transistors included in the driving circuit DC, for example, the first and second transistors T1 and T2 are N-type transistors, but the disclosure is not limited thereto. Alternatively, at least one of the first and second transistors T1 and T2 included in the driving circuit DC may be changed to a P-type transistor.

Figure 4:
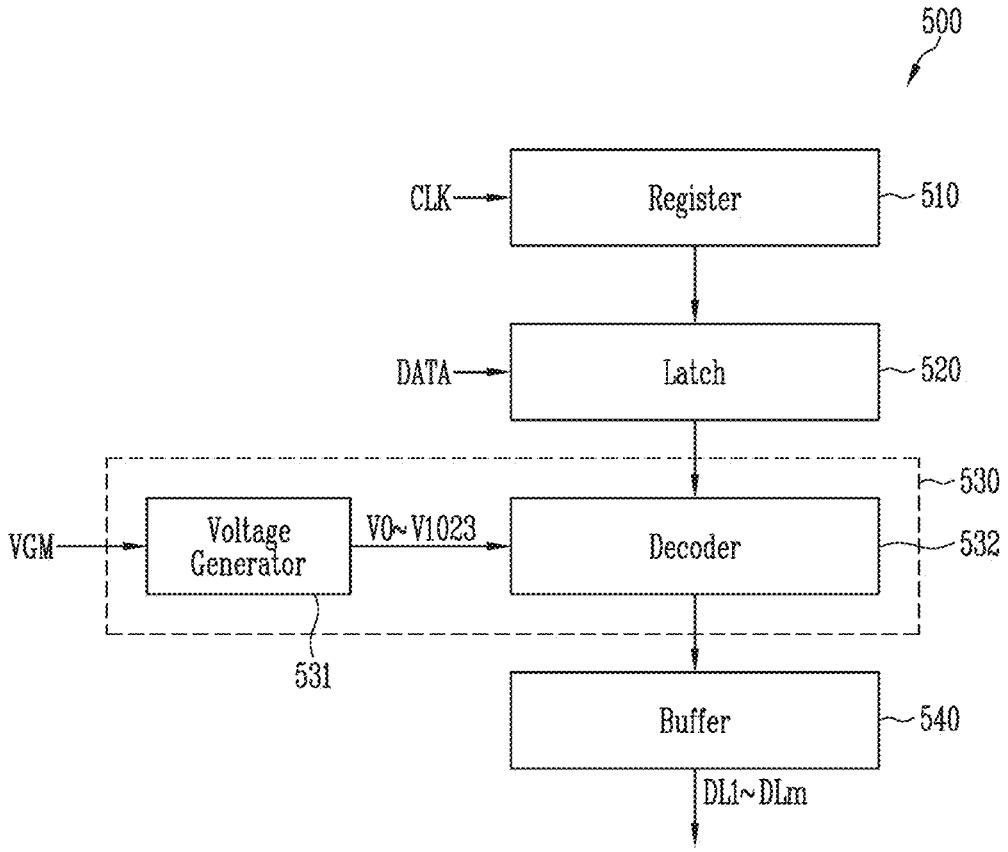
FIG. 4 is a block diagram illustrating an embodiment of a data driver included in the display device of FIG. 1.

FIG. 4 is a block diagram illustrating an embodiment of the data driver included in the display device of FIG. 1.

Referring to FIGS. 1 and 4, an embodiment of the data driver 500 may include a register 510, a latch 520, a digital-analog converter 530, and a buffer 540.

The register 510 may sequentially activate latch clock signals in synchronization with a clock signal CLK and provide the latch clock signals to the latch 520. The register 510 may include a plurality of shift registers.

The latch 520 may receive the latch clock signals sequentially provided from the register 510, and sample and latch the image data DATA of the digital format in synchronization with the latch clock signals. In addition, the latch 520 may provide the latched digital image data DATA to the digital-analog converter 530 in response to the line latch signal.

The digital-analog converter 530 may convert the digital image data DATA provided from the latch 520 into an analog signal. The digital-analog converter 530 may receive the reference voltage VGM from the power supply 600, convert the digital image data DATA into the analog signal, that is, the grayscale voltage, and provide the converted analog signal to the buffer 540 as the data signal (the data voltage).

According to an embodiment, the digital-analog converter 530 may include a voltage generator 531 and a decoder 532.

The voltage generator 531 may generate the plurality of gamma voltages for expressing a predetermined grayscale using the reference voltage VGM supplied from the power supply 600. In one embodiment, for example, the voltage generator 531 may generate the gamma voltages by voltage-dividing the reference voltage VGM using a plurality of resistors connected in series between the reference voltage VGM and the ground voltage. In one embodiment, for example, where the image data DATA is 10 bits, the voltage generator 531 may generate $2^{10}$ gamma voltages, that is, 1024 gamma voltages V0 to V1023.

In an embodiment, as described with reference to FIG. 1, when the voltage level of the reference voltage VGM supplied from the power supply 600 varies, voltages levels of the gamma voltages V0 to V1023 generated by the voltage generator 531 may also vary in response thereto.

The decoder 532 may receive the gamma voltages V0 to V1023 from the voltage generator 531 and output a gamma voltage among the gamma voltages V0 to V1023 to the buffer 540 corresponding to the input image data DATA as the data signal (data voltage).

The buffer 540 may output the data signal output from the digital-analog converter 530 to corresponding data lines DL1 to DLm.

Figure 5:
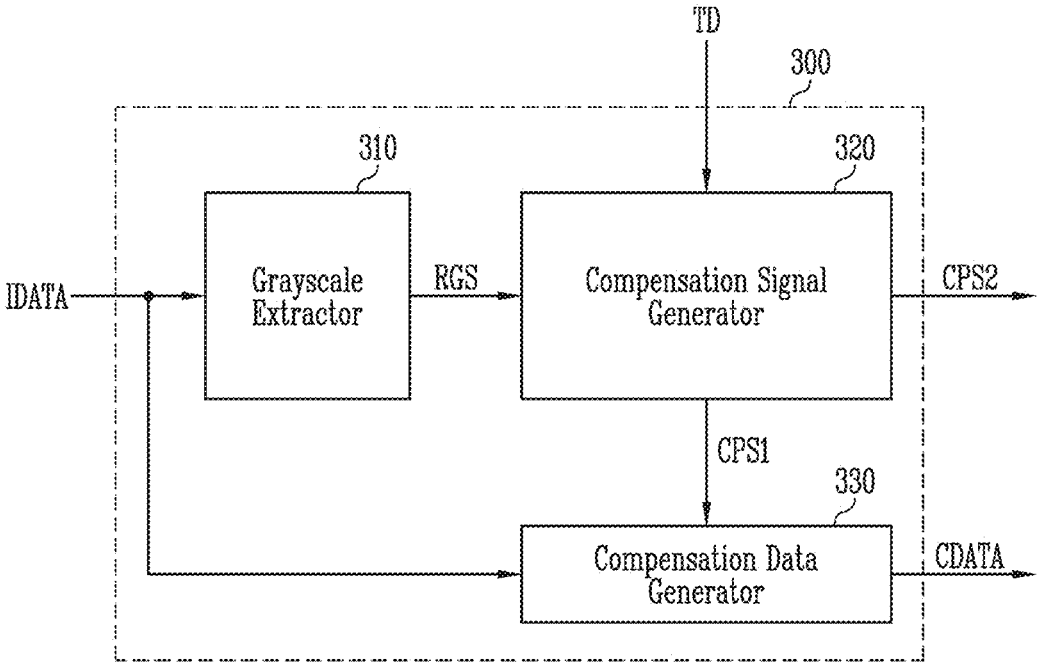
FIG. 5 is a block diagram illustrating an embodiment of a compensator included in the display device of FIG. 1.
Figure 6:
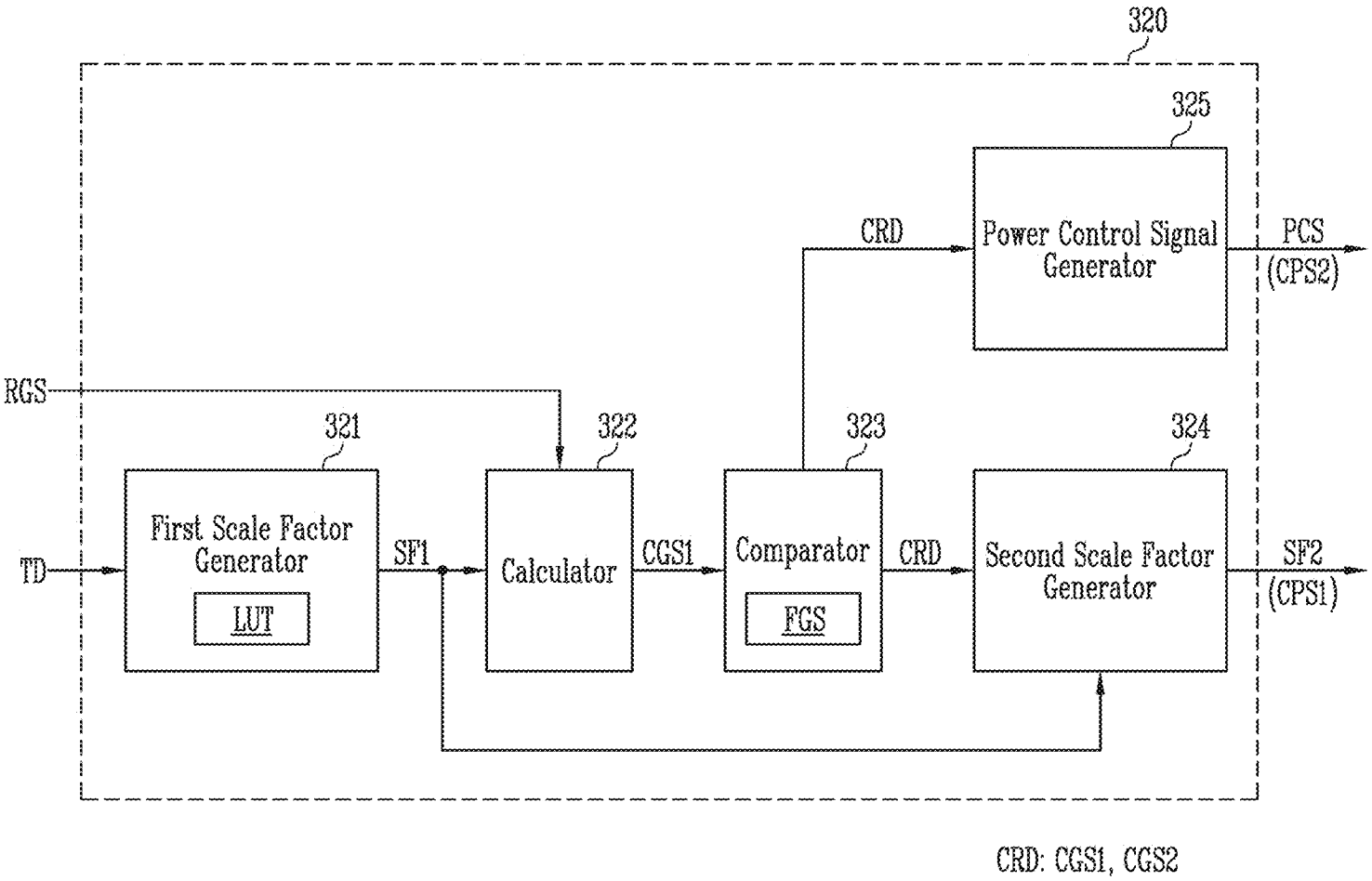
FIG. 6 is a block diagram illustrating an embodiment of a compensation signal generator included in the compensator of FIG. 5.

FIG. 5 is a block diagram illustrating an embodiment of the compensator included in the display device of FIG. 1, FIG. 6 is a block diagram illustrating an embodiment of a compensation signal generator included in the compensator of FIG. 5, and FIGS. 7A and 7B are diagrams illustrating embodiments of an operation of the compensator of FIG. 5.

Referring to FIGS. 1 and 5, an embodiment of the compensator 300 may include a grayscale extractor 310, a compensation signal generator 320, and a compensation data generator 330.

The grayscale extractor 310 may extract a representative grayscale value RGS based on the input image data IDATA. In an embodiment, the representative grayscale value RGS may correspond to the largest grayscale value among the grayscale values of the input image data IDATA.

The compensation signal generator 320 may generate a first compensation control signal CPS1 and a second compensation control signal CPS2 based on the temperature data TD. In such an embodiment, the first compensation control signal CPS1 may be the scale factor described above with reference to FIG. 1, and the second compensation control signal CPS2 may be the power control signal PCS described above with reference to FIG. 1.

The compensation data generator 330 may receive the first compensation control signal CPS1 from the compensation signal generator 320, and scale the grayscale values of the input image data IDATA based on the first compensation control signal CPS1 to generate the compensation image data CDATA.

In an embodiment, as show in FIG. 6, the compensation signal generator 320 may include a first scale factor generator 321, an operator 322, a comparator 323, a second scale factor generator 324, and a power control signal generator 325.

The first scale factor generator 321 may generate a first scale factor SF1 corresponding to the ambient temperature of the display panel 100 based on the temperature data TD.

In an embodiment, when the ambient temperature is greater than the reference temperature (for example, room temperature), the first scale factor generator 321 may generate the first scale factor SF1 having a value less than 1. In such an embodiment, as the ambient temperature increases, a value of the first scale factor SF1 generated by the first scale factor generator 321 may decrease.

In such an embodiment, when the ambient temperature is less than the reference temperature, the first scale factor generator 321 may generate the first scale factor SF1 having a value greater than 1. In such an embodiment, as the ambient temperature decreases, the value of the first scale factor SF1 generated by the first scale factor generator 321 may increase.

In such an embodiment, when the ambient temperature is the same as the reference temperature, the first scale factor generator 321 may generate the first scale factor SF1 having a value of 1.

According to an embodiment, the first scale factor generator 321 may generate the first scale factor SF1 based on a previously stored look-up table LUT. The look-up table LUT may include values of the first scale factor SF1 preset in correspondence with the ambient temperature. In one embodiment, for example, the first scale factor SF1 may be experimentally determined according to the ambient temperature.

However, this is exemplary, and the disclosure is not limited thereto. In one alternative embodiment, for example, the first scale factor generator 321 may generate the first scale factor SF1 according to the ambient temperature through a preset operation expression.

The operator 322 may receive the first scale factor SF1 from the first scale factor generator 321 and receive the representative grayscale value RGS from the grayscale extractor 310.

The operator 322 may calculate an expectation correction grayscale value CGS1 (or a first correction grayscale value) based on the representative grayscale value RGS and the first scale factor SF1. In one embodiment, for example, the operator 322 may calculate the expectation correction grayscale value CGS1 by multiplying the representative grayscale value RGS by the first scale factor SF1.

The comparator 323 may compare the expectation correction grayscale value CGS1 and a reference grayscale value FGS. Here, the reference grayscale value FGS may correspond to a maximum grayscale value (for example, 255) among the grayscale values (for example, values equal to or greater than 0 and equal to or less than 255).

The comparator 323 may calculate a final correction grayscale value CGS2 (or a second correction grayscale value) based on a result of comparing the expectation correction grayscale value CGS1 and the reference grayscale value FGS. In one embodiment, for example, the comparator 323 may calculate the final correction grayscale value CGS2 equal to the expectation correction grayscale value CGS1 when the expectation correction grayscale value CGS1 is equal to or less than the reference grayscale value FGS. In one embodiment, for example, the comparator 323 may calculate the final correction grayscale value CGS2 equal to the reference grayscale value FGS when the expectation correction grayscale value CGS1 exceeds the reference grayscale value FGS.

The comparator 323 may generate comparison result data CRD corresponding to the comparison result described above, and provide the comparison result data CRD to the second scale factor generator 324 and the power control signal generator 325. Here, the comparison result data CRD may include the expectation correction grayscale value CGS1 and the final correction grayscale value CGS2.

Based on the comparison result data CRD, the second scale factor generator 324 may generate a second scale factor SF2 (or the first compensation control signal CPS1), and the power control signal generator 325 may generate the power control signal PCS (or the second compensation control signal CPS2).

In one embodiment, for example, when the expectation correction grayscale value CGS1 and the final correction grayscale value CGS2 are the same as each other, the second scale factor generator 324 may generate the first scale factor SF1 provided from the first scale factor generator 321 as the second scale factor SF2. In such an embodiment, the second scale factor SF2 may be the same as the first scale factor SF1. Since the expectation correction grayscale value CGS1 is a value generated based on the first scale factor SF1, when the expectation correction grayscale value CGS1 and the final correction grayscale value CGS2 are the same as each other, even though the grayscale value of the input data IDATA are scaled to a same value as the first scale factor SF1, the scaled grayscale values do not exceed the reference grayscale value FGS (that is, 255 that is the maximum grayscale value). Accordingly, the second scale factor generator 324 may generate the second scale factor SF2 having a same value as the value of the first scale factor SF1.

In this case, the power control signal generator 325 may generate the power control signal PCS that controls the voltage level of the reference voltage VGM not to be varied. At this time, the power supply 600 may generate the reference voltage VGM having a same voltage level as a voltage level of the input voltage VIN based on the power control signal PCS. However, the disclosure is not limited thereto, and the power control signal generator 325 may not generate a separate power control signal PCS.

In one embodiment, for example, when the expectation correction grayscale value CGS1 and the final correction grayscale value CGS2 are not the same as each other, the second scale factor generator 324 may generate the second scale factor SF2 less than the value of the first scale factor provided from the first scale factor generator 321. When the expectation correction grayscale value CGS1 and the final correction grayscale value CGS2 are not the same as each other, the expectation correction grayscale value CGS1 corresponding to the value obtained by multiplying the representative grayscale value RGS by the first scale factor SF1 exceeds the reference grayscale value FGS (that is, 255 that is the maximum grayscale value). Accordingly, the second scale factor generator 324 may generate the second scale factor SF2 in a way such that values obtained by scaling the grayscale values of the input data IDATA are equal to or less than the reference grayscale value FGS. In one embodiment, for example, the second scale factor generator 324 may generate the second scale factor SF2 in a way such that a value obtained by scaling the representative grayscale value RGS is the same as the reference grayscale value FGS. In one embodiment, for example, the second scale factor generator 324 may generate the second scale factor SF2 based on Equation 1 below.

$$SF2 = SF1 \times \frac{CGS2}{CGS1} \quad \text{[Equation 1]}$$

In Equation 1, SF1 and SF2 denote the first scale factor SF1 and the second scale factor SF2, respectively, and CSG1 and CSG2 denote the expectation correction grayscale value CGS1 and the final correction grayscale value CGS2, respectively.

In such an embodiment, the power control signal generator 325 may generate the power control signal PCS for varying (for example, increasing) the voltage level of the reference voltage VGM. In one embodiment, for example, the power control signal generator 325 may generate the power control signal PC for increasing the voltage level of the reference voltage VGM by a rate at which the second scale factor SF2 decreases based on the first scale factor SF1. The power supply 600 may amplify the voltage level of the input voltage VIN to generate the reference voltage VGM, based on the power control signal PCS. The reference voltage VGM generated based on the power control signal PCS may be obtained according to Equation 2 below.

$$VGM = VIN \times \frac{CGS1}{CGS2} \quad \text{[Equation 2]}$$

In Equation 2, VGM denotes the reference voltage VGM, VIN denotes the input voltage VIN, and CSG1 and CSG2 denote the expectation correction grayscale value CGS1 and the final correction grayscale value CGS2, respectively.

In an embodiment, as described above, the compensator 300 may control the luminance of the display image by scaling the grayscale values of the input image data IDATA based on the ambient temperature. In such an embodiment, the compensator 300 may additionally control the luminance of the display image by controlling the scaled grayscale values not to exceed the reference grayscale value FGS corresponding to the ambient temperature and grayscale the values, and controlling (varying) the voltage level of the reference voltage VGM provided to the data driver 500. Accordingly, the display panel 100 may display the image of the target luminance regardless of change in the ambient temperature.

In an embodiment, as described above, the reference grayscale value FGS may be 255, which is the maximum grayscale value among the grayscale values. In such an embodiment, the second scale factor generator 324 may generate the second scale factor SF2 in a way such that the scaled grayscale values are included in a grayscale area (a first grayscale area GSA1 shown in FIG. 7A) equal to or less than 255, which is the maximum grayscale value.

However, the disclosure is not limited thereto, and alternatively, the second scale factor generator 324 may generate the second scale factor SF2 based on the voltage level of the reference voltage VGM and a data voltage Vdata corresponding to the grayscale values such that the grayscale values are scaled to an area of a virtual grayscale equal to or greater than 255.

In an embodiment, as shown in FIG. 7B, the display device 1000 (or the compensator 300) may generate the second grayscale area GSA2 (or the virtual grayscale area) equal to or greater than 255. Here, the second grayscale area GSA2 may not include the grayscale values of the input image data IDATA received from the outside, but may correspond to an area in which the grayscale values scaled by the second scale factor SF2 may be included.

In one embodiment, for example, values of the data voltage Vdata of the virtual grayscales in the second grayscale area GSA2 may linearly increase by a difference of the data voltage Vdata of 255 grayscale which is the maximum grayscale value and 254 grayscale. In one embodiment, for example, values of the data voltage Vdata from 256 virtual grayscale to 270 virtual grayscale may linearly increase by 0.024 volt (V) which is a difference of the data voltage Vdata of 255 grayscale and 254 grayscale.

In such an embodiment, the maximum virtual grayscale value of the second grayscale area GSA2 may be determined based on the voltage level of the reference voltage VGM. In one embodiment, for example, since the voltage generator 531 included in the data driver 500 of FIG. 4 generates the gamma voltages by voltage-dividing the reference voltage VGM, the value of the data voltage Vdata corresponding to the maximum virtual grayscale value of the second grayscale area GSA2 is used to be set to be equal to or less than the voltage level of the reference voltage VGM. In one embodiment, for example, when the voltage level of the reference voltage VGM is 8 V, the maximum virtual grayscale value of the second grayscale area GSA2 may be set 270 virtual grayscale corresponding to the data voltage Vdata of 7.988 V.

In an embodiment, as described above, the display device 1000 may additionally secure the second grayscale area GSA2, which is the virtual grayscale area corresponding to the voltage level of the reference voltage VGM supplied to the data driver 500, as well as the first grayscale area GSA1. In such an embodiment, since the compensator 300 may set the reference grayscale value FGS to a value (for example, 270) corresponding to the maximum virtual grayscale value of the second grayscale area GSA2, not 255 grayscale, a range of the second scale factor SF2 that may be generated by the second scale factor generator 324 may be increased. Accordingly, the compensation signal generator 320 may not separately generate the power control signal PCS for varying the voltage level of the reference voltage VGM based on the ambient temperature, and a range in which the luminance of the display image may be controlled may be wider only by the second scale factor SF2.

Figure 8:
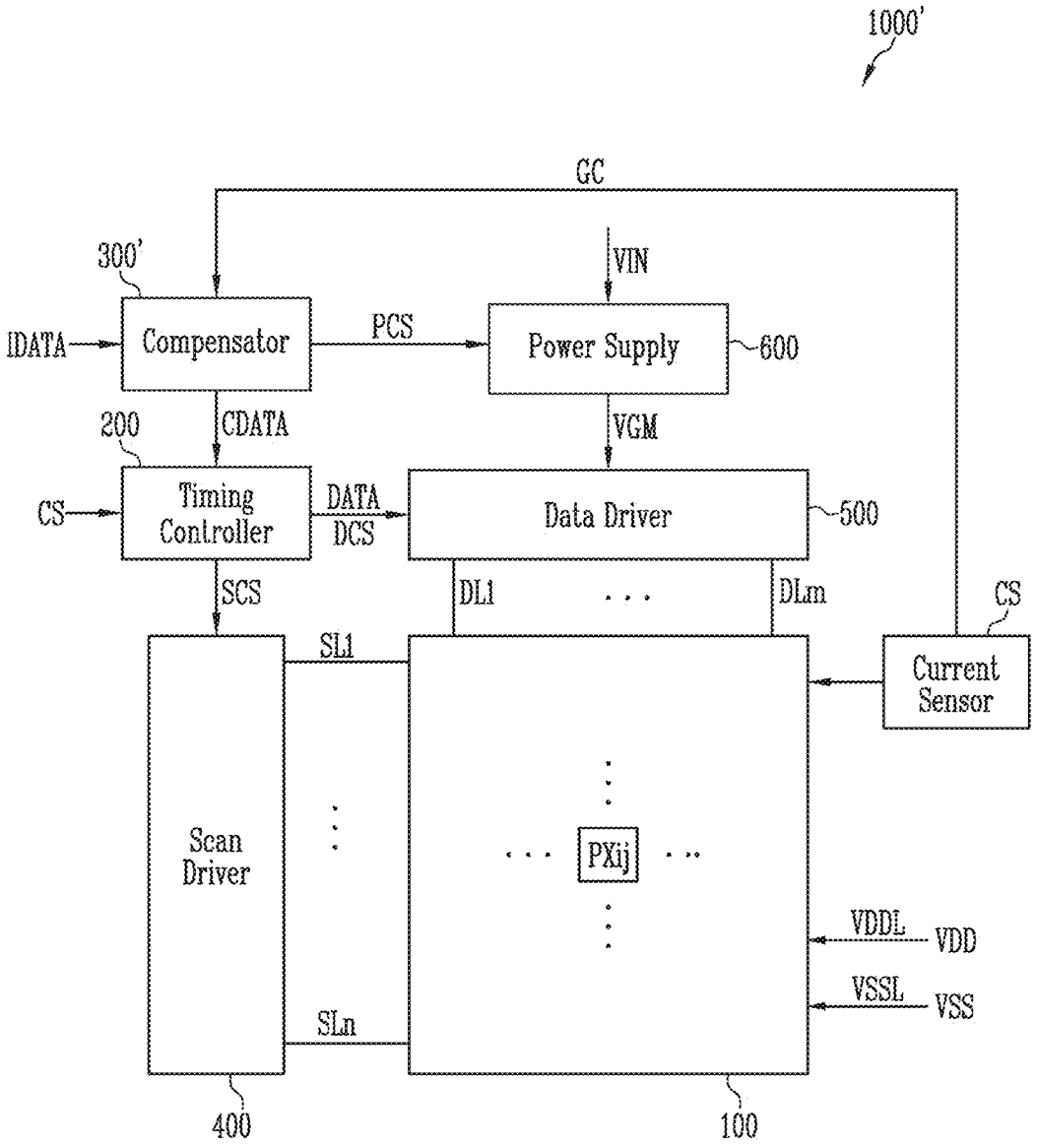
FIG. 8 is a block diagram illustrating a display device according to an alternative embodiment of the disclosure.
Figure 9:
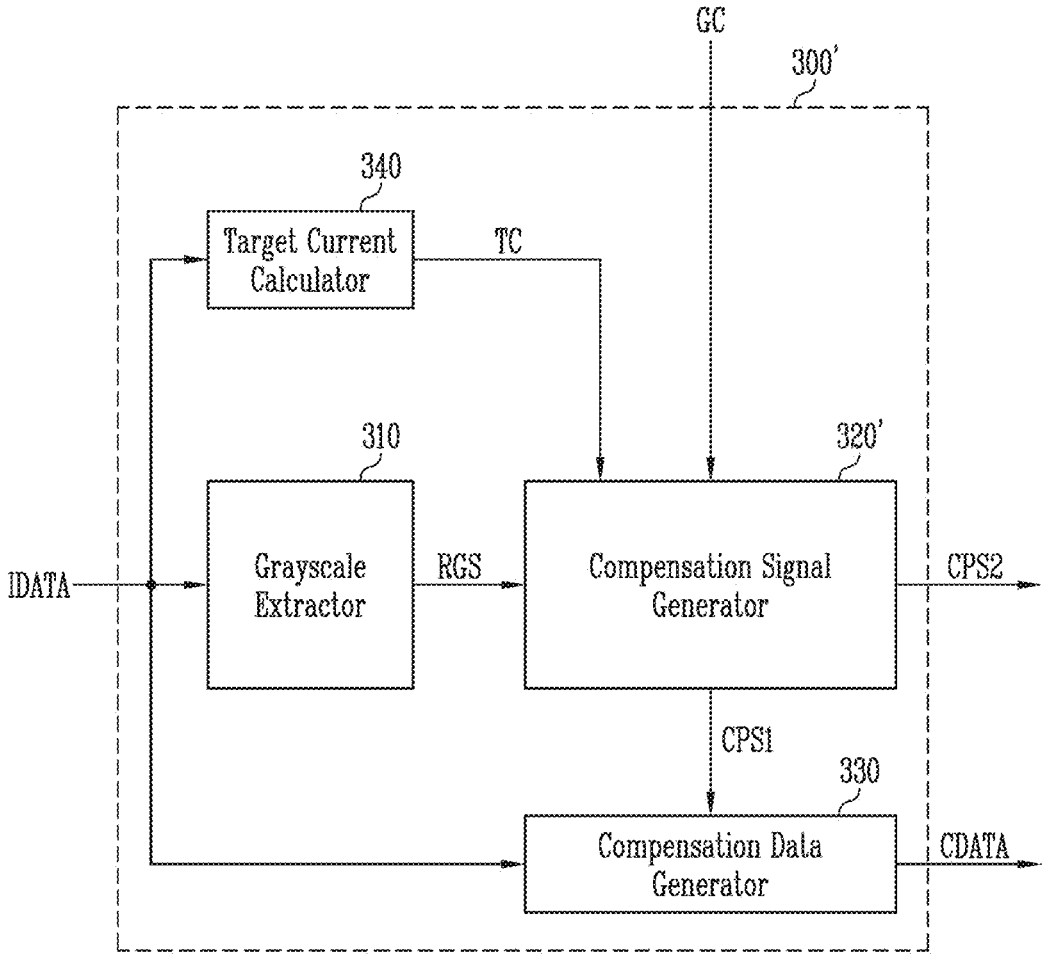
FIG. 9 is a block diagram illustrating an embodiment of a compensator included in the display device of FIG. 8.

FIG. 8 is a block diagram illustrating a display device according to an alternative embodiment of the disclosure, and FIG. 9 is a block diagram illustrating an embodiment of a compensator included in the display device of FIG. 8.

The display device 1000' of FIG. 8 and the compensator 300' of FIG. 9 are substantially the same as or similar to the display device 1000 of FIG. 1 and the compensator 300 of FIG. 5, respectively, except for some components, and thus any repetitive detailed description of the same or like element will hereinafter be omitted or simplified.

Referring to FIG. 8, an embodiment of the display device 1000' may include the display panel 100, the timing controller 200, the compensator 300', the scan driver 400, the data driver 500, and the power supply 600.

According to an embodiment, as shown in FIG. 8, the display device 1000' may further include a current sensor CS. The current sensor CS may sense a current flowing through the display panel 100 to generate a global current value GC. Here, a value of the current flowing through the display panel 100 may be different or changed based on the ambient temperature of the display panel 100. In one embodiment, for example, when the ambient temperature of the display panel 100 increases to a temperature equal to or greater than the reference temperature, the value of the current flowing through the display panel 100 may increase (that is, a value of the global current GC increases). In such an embodiment, when the ambient temperature of the display panel 100 decreases to a temperature equal to or less than the reference temperature, the value of the current flowing through the display panel 100 may decrease (that is, the value of the global current GC decreases).

In an embodiment, the current sensor CS may be connected to the first power line VDDL commonly connected to the pixels PXij. The current sensor CS senses a current flowing through the first power line VDDL to generate a global current value GC. Here, the global current value GC may correspond to a current commonly supplied to all pixels PXij through the first power line VDDL. However, the disclosure is not limited thereto, and alternatively, the current sensor CS may be connected to the second power line VSSL commonly connected to the pixels PXij, and sense a current flowing through the second power line VSSL.

The current sensor CS may provide the global current value GC to the compensator 300'.

In an embodiment, the compensator 300' may generate a scale factor based on the global current value GC. In one embodiment, for example, the compensator 300' may calculate a target current value corresponding to the input image data IDATA, compare the target current value with the global current value GC, and generate the scale factor (for example, the second scale factor SF2 described with reference to FIG. 6) for controlling to flow a current of the target current value through the display panel 100.

In an embodiment, as shown in FIG. 9, the compensator 300' may include the grayscale extractor 310, a compensation signal generator 320', the compensation data generator 330, and a target current calculator 340.

The target current calculator 340 may calculate a target current value TC based on the input image data IDATA. Here, the target current value TC may correspond to a current value to be flowed through the display panel 100 in correspondence with the grayscale values of the input image data IDATA. In one embodiment, for example, the target current calculator 340 may calculate the target current value TC corresponding to the grayscale values of the input image data IDATA through a pre-stored look-up table or a preset operation equation.

The compensation signal generator 320' may generate the first compensation control signal CPS1 and the second compensation control signal CPS2 based on the target current value TC and the global current value GC.

In such an embodiment, the compensation signal generator 320' may compare the target current value TC and the global current value GC to generate the first scale factor SF1 described above with reference to FIG. 6. In one embodiment, for example, the compensation signal generator 320' may determine a ratio between the target current value TC and the global current value TC as the first scale factor SF1.

In one embodiment, for example, when the ambient temperature of the display panel 100 is greater than the reference temperature, since the global current value GC is greater than the target current value TC, the compensation signal generator 320' may generate the first scale factor SF1 having a value less than 1.

In one embodiment, for example, when the ambient temperature of the display panel 100 is less than the reference temperature, since the global current value GC is less than the target current value TC, the compensation signal generator 320' may generate the first scale factor SF1 having a value greater than 1.

As described above, an embodiment of the display device 1000' may directly sense the global current value GC that changes based on the ambient temperature, and generate the scale factor based on the global current value GC. Accordingly, luminance compensation of the display image based on the ambient temperature may be more accurately performed.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A display device comprising:

a pixel unit including pixels;

a compensator which generates compensation image data by scaling grayscale values of input image data based on temperature data corresponding to an ambient temperature of the pixel unit;

a timing controller which generates image data based on the compensation image data; and a data driver which generates a data signal corresponding to the image data and supplies the data signal to the pixels, wherein the compensator scales the grayscale values of the input image data in a way such that the grayscale values of the input image data decrease when the ambient temperature is greater than a reference temperature, and the grayscale values of the compensation image data are less than the grayscale values of the input image data, and wherein the compensator scales the grayscale values of the input image data in a way such that the grayscale values of the input image data increase when the ambient temperature is less than the reference temperature, and the grayscale values of the compensation image data are greater than the grayscale values of the input image data.

2. The display device according to claim 1, further comprising:

a power supply which generates a reference voltage using an input voltage, wherein the data driver generates the data signal using the reference voltage, and the compensator further generates a power control signal for controlling a voltage level of the reference voltage based on the temperature data.

3. The display device according to claim 2, wherein the compensator comprises:

a grayscale extractor which extracts a representative grayscale value based on the input image data;

a compensation signal generator which generates a first compensation control signal and a second compensation control signal based on the temperature data and the representative grayscale value; and a compensation data generator which generates the compensation image data based on the input image data and the first compensation control signal.

4. The display device according to claim 3, wherein the representative grayscale value corresponds to a largest grayscale value among the grayscale values of the input image data.

5. The display device according to claim 3, wherein the compensation signal generator comprises:

a first scale factor generator which generates a first scale factor corresponding to the ambient temperature based on the temperature data;

an operator which calculates a first correction grayscale value based on the first scale factor and the representative grayscale value;

a comparator which compares the first correction grayscale value and a reference grayscale value to generate comparison result data; and a second scale factor generator which generates a second scale factor corresponding to the first compensation control signal based on the comparison result data.

6. The display device according to claim 5, wherein the first scale factor generator generates the first scale factor having a value greater than 1 when the ambient temperature is less than the reference temperature, and the value of the first scale factor increases as the ambient temperature decreases.

7. The display device according to claim 5, wherein the first scale factor generator generates the first scale factor having a value less than 1 when the ambient temperature is greater than the reference temperature, and the value of the first scale factor decreases as the ambient temperature increases.

8. The display device according to claim 5, wherein the first scale factor generator generates the first scale factor having a value of 1 when the ambient temperature and the reference temperature are the same as each other.

9. The display device according to claim 5, wherein the operator calculates the first correction grayscale value by multiplying the representative grayscale value by the first scale factor.

10. The display device according to claim 5, wherein the comparator calculates a second correction grayscale value in response to the comparison result data.

11. The display device according to claim 10, wherein the comparator calculates the second correction grayscale value to be equal to the first correction grayscale value when the first correction grayscale value is equal to or less than the reference grayscale value, and the comparator calculates the second correction grayscale value to be equal to the reference grayscale value when the first correction grayscale value exceeds the reference grayscale value.

12. The display device according to claim 10, wherein the compensation signal generator further comprises a power control signal generator which generates the power control signal corresponding to the second compensation control signal based on the comparison result data.

13. The display device according to claim 12, wherein the second scale factor generator generates the second scale factor having a value less than the first scale factor when the first correction grayscale value and the second correction grayscale value are not the same as each other.

14. The display device according to claim 13, wherein a value obtained by applying the second scale factor to the representative grayscale value corresponds to the reference grayscale value.

15. The display device according to claim 13, wherein the power supply generates the reference voltage having a voltage level different from a voltage level of the input voltage based on the power control signal.

16. The display device according to claim 12, wherein the second scale factor generator generates the second scale factor having a same value as the first scale factor when the first correction grayscale value and the second correction grayscale value are the same as each other.

17. The display device according to claim 16, wherein the power supply generates the reference voltage having a same voltage level as the input voltage based on the power control signal.

18. A display device comprising:

a pixel unit including pixels;

a compensator which generates compensation image data by calculating a target current value corresponding to input image data and scaling grayscale values of the input image data based on the target current value and a global current value flowing through the pixels;

a timing controller which generates image data based on the compensation image data; and a data driver which generates a data signal corresponding to the image data and supplies the data signal to the pixels, wherein the compensator scales the grayscale values of the input image data in a way such that the grayscale values of the input image data decrease when the global current value is greater than the target current value, and the grayscale values of the compensation image data are less than the grayscale values of the input image data, and the compensator scales the grayscale values of the input image data in a way such that the grayscale values of the input image data increase when the global current value is less than the target current value, and the grayscale values of the compensation image data are greater than the grayscale values of the input image data.

19. The display device according to claim 18, further comprising:

a power supply which generates a reference voltage using an input voltage, wherein the data driver generates the data signal using the reference voltage, and the compensator further generates a power control signal for controlling a voltage level of the reference voltage based on the target current value and the global current value.

20. The display device according to claim 18, wherein the pixels are connected to a power line, and the display device further comprises a current sensor which generates the global current value by sensing a current flowing through the power line.

* * * * *